US006676478B1

(12) United States Patent
Starner

(10) Patent No.: US 6,676,478 B1
(45) Date of Patent: Jan. 13, 2004

(54) TEDDY BEAR PLUSH TOY AND GAME COMBINATION

(76) Inventor: David S. Starner, 2709 Tifft St., Cuyahoga Falls, OH (US) 44221

( * ) Notice: Subject to any disclaimer, the term of this patent is extended or adjusted under 35 U.S.C. 154(b) by 0 days.

(21) Appl. No.: 09/376,047

(22) Filed: Jul. 22, 2002

(51) Int. Cl.[7] ..... A63H 3/02

(52) U.S. Cl. ..... 446/369; 446/73; 446/901; 273/348.4

(58) Field of Search ..... 446/369, 901, 446/71, 72, 73, 268; 273/348.4, 348

(56) References Cited

U.S. PATENT DOCUMENTS

| | | | | | |
|---|---|---|---|---|---|
| 1,330,043 | A | | 2/1920 | Offutt | |
| 3,668,805 | A | | 6/1972 | Coleman | 46/151 |
| 3,927,881 | A | * | 12/1975 | Lemelson et al. | 473/573 |
| 3,953,030 | A | * | 4/1976 | Muchnick | 273/348.4 |
| 4,288,222 | A | | 9/1981 | Kling | 434/272 |
| 4,543,278 | A | * | 9/1985 | Ackerman | 446/901 |
| 4,579,537 | A | | 4/1986 | Leahy | 446/100 |
| 4,671,514 | A | * | 6/1987 | Wilson-Diehl | 446/901 |
| 4,824,414 | A | * | 4/1989 | Goldblatt | 446/901 |
| 4,883,441 | A | * | 11/1989 | Byer | 446/369 |
| 4,950,196 | A | * | 8/1990 | Fortune et al. | 446/73 |
| 4,968,279 | A | * | 11/1990 | Smith | 446/369 |
| D317,798 | S | * | 6/1991 | Warcholik | D21/596 |
| 5,022,886 | A | | 6/1991 | Jenkins | 446/268 |
| 5,082,291 | A | * | 1/1992 | Appel et al. | 273/348.4 |
| 5,092,778 | A | * | 3/1992 | Shaver et al. | 446/369 |
| 5,108,108 | A | * | 4/1992 | Norman et al. | 273/241 |
| 5,141,465 | A | * | 8/1992 | Stellman | 446/369 |
| 5,186,673 | A | | 2/1993 | Fogarty et al. | 446/98 |
| 5,195,917 | A | | 3/1993 | Russell et al. | 446/97 |
| 5,232,390 | A | * | 8/1993 | Brooks | 446/72 |
| 5,261,673 | A | * | 11/1993 | Miller | 473/514 |
| 5,328,400 | A | | 7/1994 | Bass | 446/98 |
| 5,344,355 | A | | 9/1994 | Silverstein | 446/72 |
| 5,344,356 | A | * | 9/1994 | Pizzelli et al. | 446/901 |
| 5,348,510 | A | * | 9/1994 | DuPont et al. | 446/901 |
| 5,372,509 | A | * | 12/1994 | Brocato et al. | 446/268 |
| 5,762,569 | A | * | 6/1998 | Hale | 473/480 |
| 5,779,570 | A | * | 7/1998 | Bear | 446/369 |
| 5,829,073 | A | * | 11/1998 | Lee | 446/901 |
| 5,848,900 | A | | 12/1998 | Pearson | 434/236 |
| 6,056,618 | A | * | 5/2000 | Larian | 446/268 |
| D428,453 | S | * | 7/2000 | Reithmeier | D21/650 |
| 6,234,863 | B1 | * | 5/2001 | Hughey et al. | 446/369 |
| 6,280,283 | B1 | * | 8/2001 | Sisler | 446/369 |
| 6,422,558 | B1 | * | 7/2002 | Chambers | 273/146 |

OTHER PUBLICATIONS

HappyBalls.com, Happy Bee, Internet—http://www.happy-balls.com, 2003.*

* cited by examiner

*Primary Examiner*—Derris H. Banks
*Assistant Examiner*—Urszula M Cegielnik
(74) *Attorney, Agent, or Firm*—John D. Gugliotta

(57) ABSTRACT

A teddy bear plush toy and game combination is disclosed, comprised of a plush, or stuffed, toy that is configured as a teddy bear. The teddy bears holds a container configured to resemble a bee hive. The container has a removable lid. Small bee-shaped plastic balls, called "bees", are stored inside of the container. The plastic balls are covered with strips of hook and loop fastener, such as VELCRO®. The container is releasably affixed to the teddy bear itself. The teddy bear plush toy and game combination can be used as a traditional teddy bear, or used as a game by throwing the balls at the teddy bear.

8 Claims, 5 Drawing Sheets

TEDDY BEAR PLUSH TOY AND GAME COMBINATION

RELATED APPLICATIONS AND DISCLOSURES

The present invention was first disclosed in the Disclosure Document filed on Jan. 9, 1999. There have been no previously filed, nor any co-pending applications, anywhere in the world.

BACKGROUND OF THE INVENTION

1. Field of the Invention

The present invention relates generally to children's toys, and, more particularly, to a teddy bear plush toy and game combination.

2. Description of the Related Art

The toy industry is a multi billion dollar, global industry that is continually growing as more and more products are developed and introduced to the buying public. The toy industry is somewhat unique in the sense that it is highly susceptible to trendy products or fads.

This is due most likely to the fact that children fall easily to peer pressure and, as a result, when a toy product achieves a certain level of popularity among children, demand can skyrocket in a domino effect manner.

That is not necessarily to say that these products require revolutionary or innovative designs. To the contrary, items such as Cabbage Patch and Tickle Me Elmo are otherwise conventional dolls that have achieved enormous, even record, popularity based primarily on their attractiveness to children.

The functionality of the invention comes from the combination of existing games and concepts with a twist, to create a new and novel product that children love. This being the case, one never can tell what the success of a new toy will be. In fact, new toys and games are essential to keeping children's interest in playing peaked.

Children of all ages enjoy playing games, and are always on the lookout for new and novel games that are enjoyable to play. Parents appreciate these games, since they keep their children from getting into trouble. Children also enjoy holding and playing with teddy bears.

The teddy bear is a favorite among children. Incorporating a teddy bear configuration into a children's game adds both the excitement of the game with the recognition and lovableness of a teddy bear configuration. Such a configuration also provides the child with the choice of playing with the stuffed teddy bear as a plush toy or playing the game which incorporates the plush toy. Such a configuration also saves the parents money, in that the child receives a plush toy and game in one.

In the related art, several devices are disclosed that describe removable clothing for a doll. These include U.S. Pat. No. 5,328,400, issued in the name of Bass, U.S. Pat. No. 5,186,673, issued in the name of Fogarty et al., U.S. Pat. No. 5,022,886, issued in the name of Jenkins, U.S. Pat. No. 3,668,805, issued in the name of Coleman and U.S. Pat. No. 1,330,043, issued in the name of Offutt.

U.S. Pat. No. 4,288,222, issued in the name of Kling, describes a doll with removable organs.

U.S. Pat. No. 5,848,900, issued in the name of Pearson, discloses an educational doll with changeable face elements.

U.S. Pat. No. 5,344,355, issued in the name of Silverstein, describes a toy doll with a detachable pacifier.

U.S. Pat. No. 5,195,917, issued in the name of Russell et al, describes a tear-apart stress relief doll and method.

U.S. Pat. No. 4,579,537, issued in the name of Leahy, discloses a take-apart toy that can be reassembled.

A search of the prior art did not disclose any patents that anticipate directly many features of the instant invention. Consequently, a need has been felt for providing a new game and plush toy combination that incorporates the teddy bear plush toy configuration with an action children's game.

SUMMARY OF THE INVENTION

It is therefore an object of the present invention to provide an improved teddy bear plush toy and game combination that allows children to enjoy the benefits of a plush toy teddy bear while also allowing the present invention to be used as a game.

Briefly described according to one embodiment of the present invention, a teddy bear plush toy and game combination is disclosed, comprising a plush, or stuffed, toy that is configured as a teddy bear. The teddy bear holds a container configured to resemble a bee hive. The container has a removable lid. Small bee-shaped plastic balls, call "bees", are stored inside of the container. The plastic balls are covered with strips of hook and loop fastener, such as VELCRO®. The container is releasably affixed to the teddy bear itself.

To use the present invention as a game, the teddy bear may be placed in a sitting position on a floor or other flat surface. A child or group of children, then take turns throwing the bee shaped balls at the teddy bear. A winning throw occurs when the "bees" sticks to the bear. When finished, the "bees" are stored back in the container for safekeeping. Additionally, the child may play with the present invention like any other stuffed animal, with or without the container attached to the teddy bear.

It is another object of the present invention to provide a device that can be used as both a game and a plush toy. This provides the child with the choice of playing with either the teddy bear as a plush toy or using the teddy bear to play the game. This also saves the parents money, as the child receives both the stuffed toy and the game in one.

DESCRIPTIVE KEY

| DESCRIPTIVE KEY | |
|---|---|
| 10 | teddy bear plush toy and game combination |
| 20 | teddy bear |
| 30 | container |
| 40 | lid |
| 50 | ball |
| 60 | hook and loop fastener |
| 70 | container securement means |

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTION OF THE PREFERRED EMBODIMENTS

The best mode for carrying out the invention is presented in terms of its preferred embodiment, herein depicted within the FIGS. 1 through 9.

1. Detailed Description of the Figures

Figure 1:
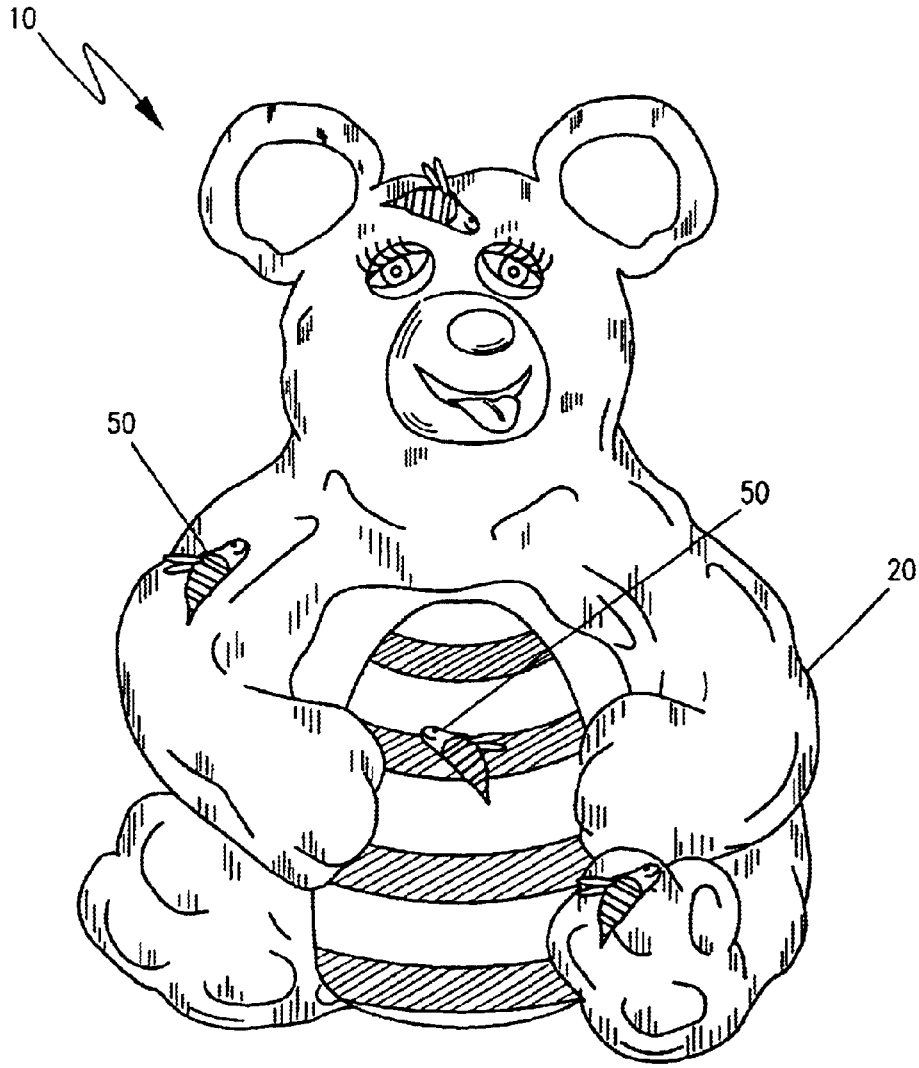
FIG. 1 is a perspective view of the preferred embodiment of teddy bear plush toy and game combination 10.
Figure 2:
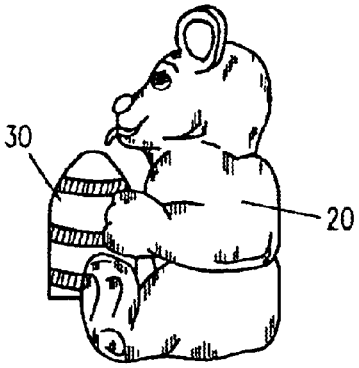
FIG. 2 is a left side view thereof, the right side view being a mirror image of the left side view.
Figure 3:
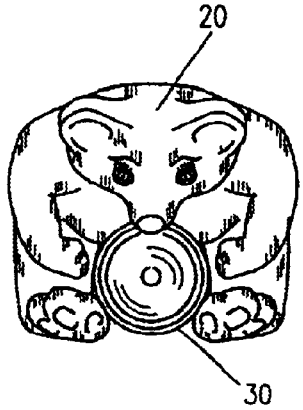
FIG. 3 is a top view thereof.
Figure 4:
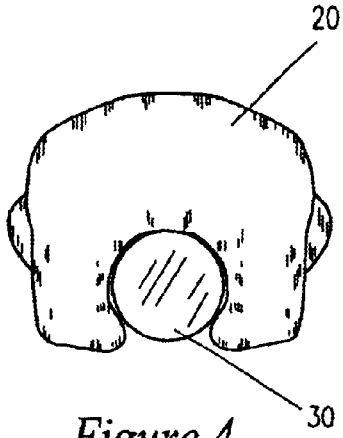
FIG. 4 is a bottom view thereof.
Figure 5:
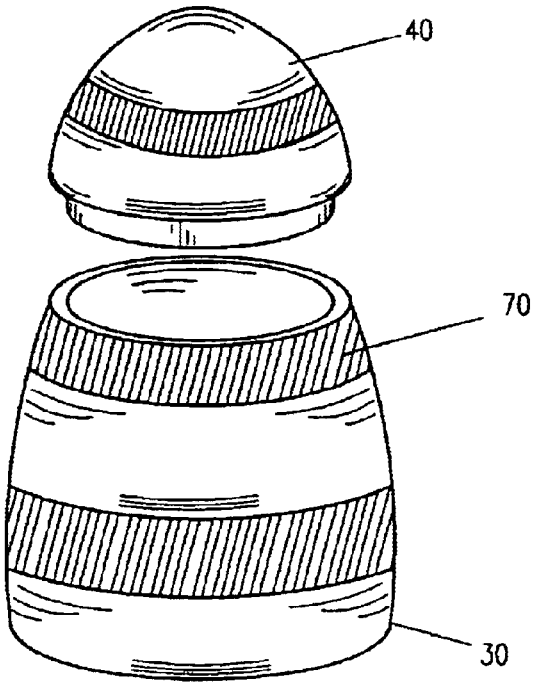
FIG. 5 is a perspective view of the container.

Referring now to FIG. 1, a teddy bear plush toy and game combination 10 is shown, according to the present invention, designed as an improved teddy bear plush toy and game combination that allows children to enjoy the benefits of a plush toy teddy bear while also allowing the present invention to be used as a game.

Referring now to FIGS. 1 through 4, the present invention comprises a plush, or stuffed, toy that is configured to appear like an otherwise traditional teddy bear 20.

Referring now to FIGS. 1 through 5, the teddy bear 20 holds a container 30 which is configured to resemble a bee hive. The container 30 is hollow inside and has a removable lid 40.

Figure 6:
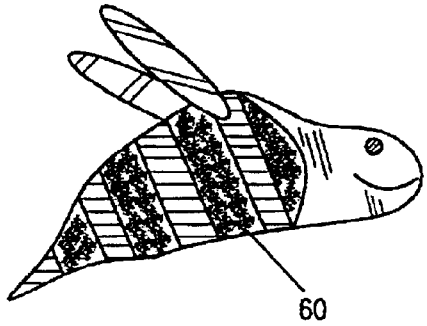
FIG. 6 is a perspective view of a bee-shaped ball.
Figure 7:
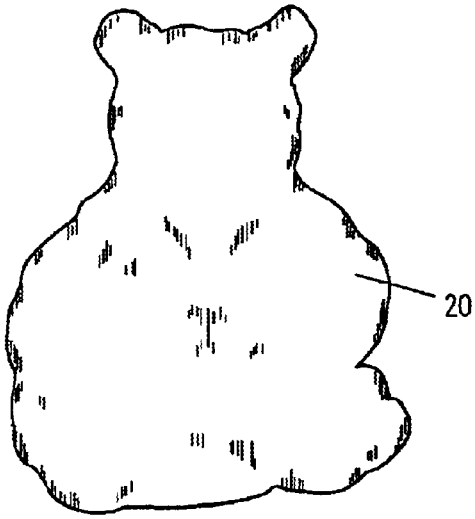
FIG. 7 is a rear view of the present invention.

Referring now to FIGS. 1 and 6, small bee-shaped plastic balls 50, called "bees", are stored inside of the container 30. The balls 50 are configured to appear as bees. The bee-shaped balls 50 are constructed of plastic, but other materials are envisioned. In addition, numerous shapes of the balls 50 are envisioned.

The balls 50 are covered with strips of hook and loop fastener 60, such as VELCRO®. The plastic bee-shaped balls 50 and the teddy bear 20 exterior surface are designed so that the plastic bee-shaped balls 50 will releasably attach to the teddy bear's 20 exterior surface when each plastic ball is thrown against the teddy bear 20.

Referring now to FIGS. 1 and 6, the container 30 is releasably affixed to the teddy bear 20 itself by a container 30 securement means. For purposes of disclosure, the container 30 securement means is depicted as hook and loop fasteners 60.

It is envisioned that other styles and configurations of the present invention can be easily incorporated into the teachings of the present invention, and only one particular configuration shall be shown and described for purposes of clarity and disclosure and not by way of limitation of scope.

2. Operation of the Preferred Embodiment

Figure 8:
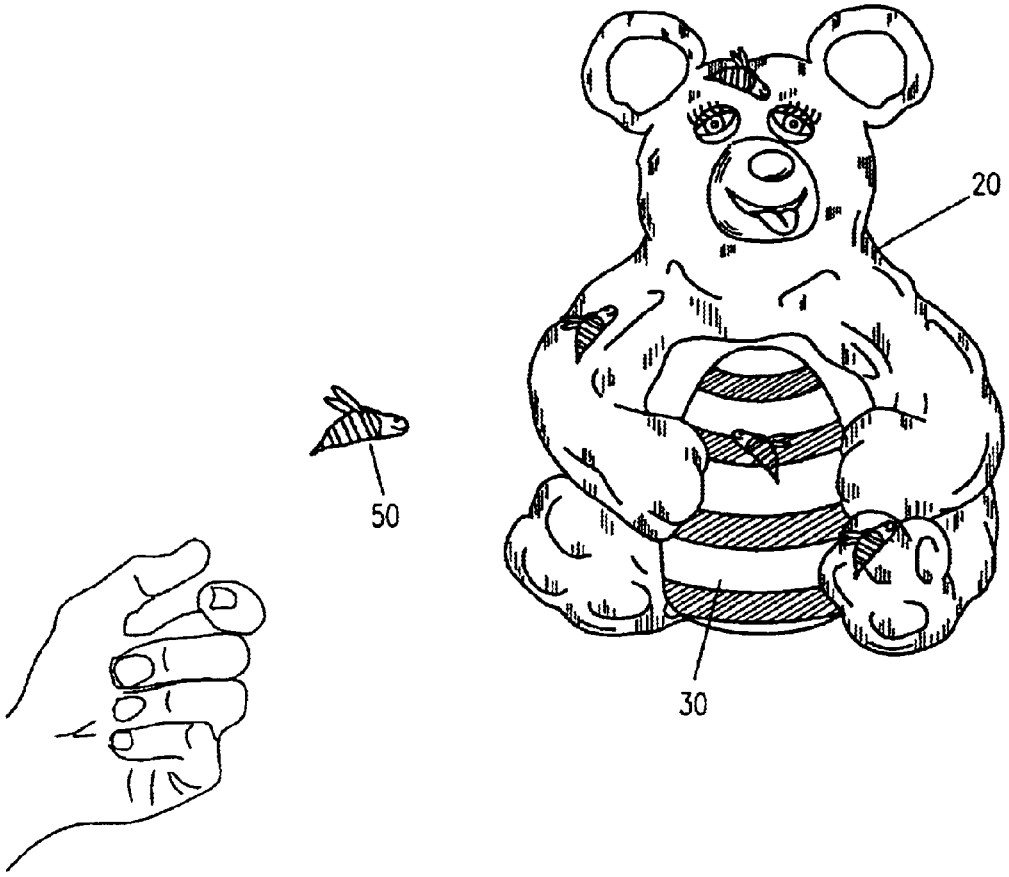
FIG. 8 is an in-use view of the present invention being used as a game.

Referring now to FIG. 8, to use the present invention as a game, the teddy bear 20 may be placed in a sitting position on a floor or other flat surface. A child or group of children, then take turns throwing the bee-shaped balls 50 at the teddy bear 20. A winning throw occurs when ball sticks to the teddy bear 20. When finished, the bee-shaped balls 50 are stored back in the container 30 for safekeeping.

Figure 9:
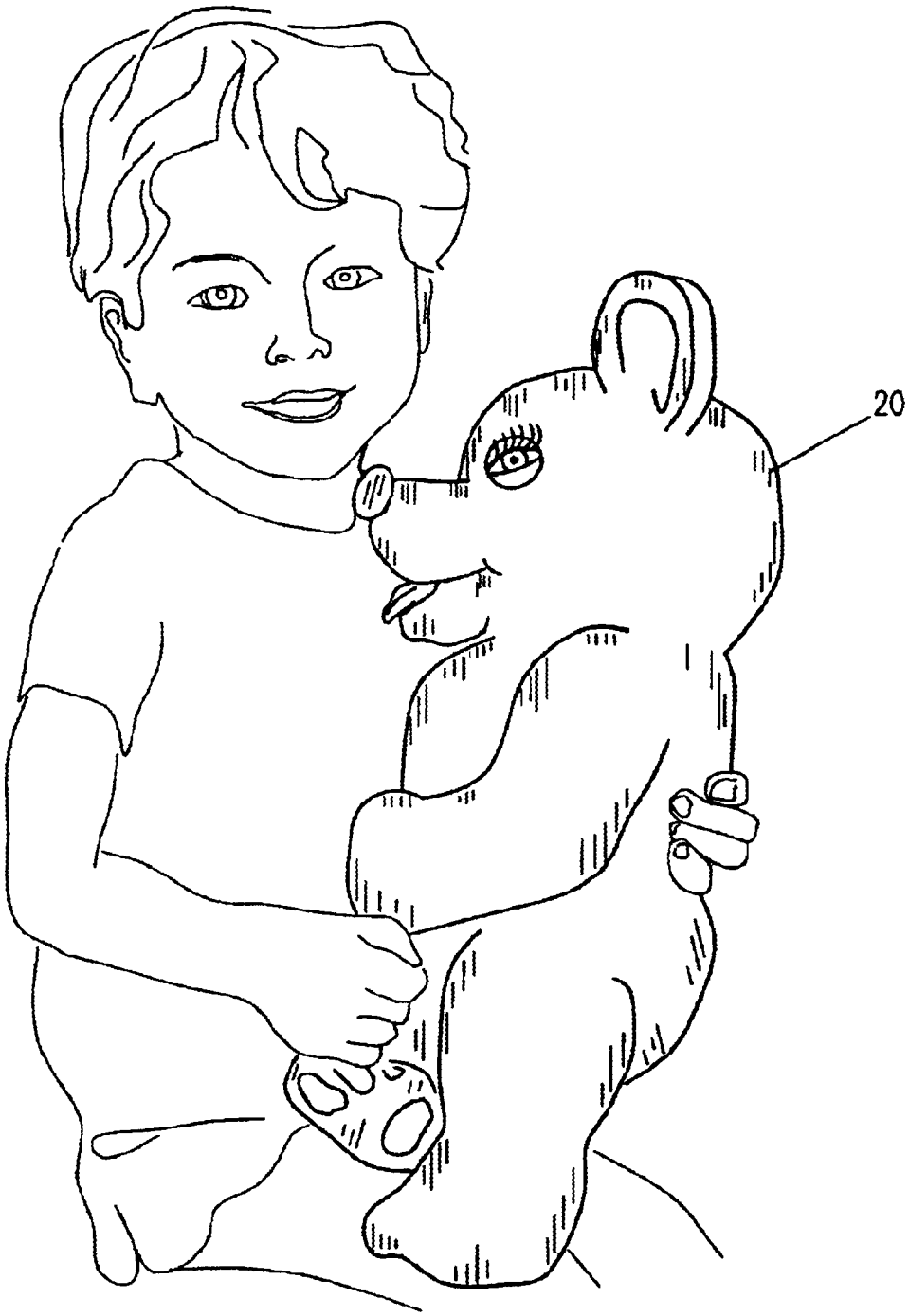
FIG. 9 is an in-use view of the present invention being used as a stuffed toy.

Referring now to FIG. 9, in addition, the child may play with the present invention like any other stuffed animal, with or without the container 30 attached to the teddy bear 20. This is accomplished by detaching the container 30 from the teddy bear 20.

The foregoing description is included to illustrate the operation of the preferred embodiment and is not meant to limit the scope of the invention. The scope of the invention is to be limited only by the following claims.

What is claimed is:

1. A teddy bear plush toy and game combination comprising:

a plush toy that is a teddy bear;

a container, said container being releasably secured to said plush toy so as to appear that said plush toy is holding said container;

a plurality of balls;

wherein each one of said plurality of balls is elongated with wings, each one of said plurality of balls covered in hook and loop fasteners for releasable securement to an exterior surface of said plush toy when one of said plurality of balls is thrown against said plush toy.

2. The teddy bear plush toy and game combination described in claim 1, wherein said container is conically shaped.

3. The teddy bear plush toy and game combination described in claim 1, wherein said container is releasably secured to said plush toy via container securement means.

4. The teddy bear plush toy and game combination described in claim 3, wherein said container securement means is hook and loop fasteners.

5. The teddy bear plush toy and game combination described in claim 1, wherein said container is hollow and holds said plurality of balls inside of said container.

6. The teddy bear plush toy and game combination described in claim 1, wherein said container has a releasable lid.

7. The teddy bear plush toy and game combination described in claim 1, wherein to use said teddy bear plush toy and game combination as a game, said plush toy may be placed in a sitting position on a floor or other flat surface; a child or group of children, then take turns throwing one of said plurality of balls at said plush toy; a winning throw occurs when ball sticks to said plush toy; said balls are stored back in said container for safekeeping upon completion.

8. The teddy bear plush toy and game combination described in claim 1, wherein a child may play with said plush toy like any other stuffed animal, with or without said container attached to said plush toy; this being accomplished by detaching said container from said plush toy.

* * * * *